US005537769A

United States Patent [19]

Hargraves et al.

[11] Patent Number: 5,537,769

[45] Date of Patent: Jul. 23, 1996

[54] LIGHTWEIGHT STRIKER

[76] Inventors: John T. Hargraves, 1981 Holman Rd., Hoschton, Ga. 30548; Richard W. Meier, 8880 Glen Ferry Dr., Alpharetta, Ga. 30245

[21] Appl. No.: 370,848

[22] Filed: Jan. 10, 1995

[51] Int. Cl.[6] ..... F41A 19/13

[52] U.S. Cl. ..... 42/69.01

[58] Field of Search ..... 42/69.02, 69.01, 42/70.08

[56] References Cited

U.S. PATENT DOCUMENTS

| | | | |
|---|---|---|---|
| 146,658 | 1/1874 | Dane . | |
| 217,001 | 7/1879 | Davis . | |
| 469,561 | 2/1892 | Haines | 42/69.01 |
| 548,075 | 10/1895 | Lundgren | 42/69.01 |
| 1,294,295 | 2/1919 | Mendoza | 42/69.02 |
| 1,780,521 | 11/1930 | Garand | 42/70.08 |
| 2,089,581 | 8/1937 | Sedgley | 42/16 |
| 3,595,128 | 7/1971 | Hoyt, Jr. | 89/27 |
| 3,683,537 | 8/1972 | Silva | 42/69.02 |
| 4,385,463 | 5/1983 | Casull | 42/65 |
| 4,539,889 | 9/1985 | Glock | 89/147 |
| 4,825,744 | 5/1989 | Glock | 89/145 |
| 4,893,546 | 1/1990 | Glock | 89/145 |
| 5,421,119 | 6/1995 | Miner | 42/69.01 |

FOREIGN PATENT DOCUMENTS

| | | | |
|---|---|---|---|
| 351622 | 11/1935 | Germany | 42/70.08 |
| 678090 | 6/1939 | Germany | 42/69.02 |

*Primary Examiner*—Stephen M. Johnson
*Attorney, Agent, or Firm*—Louis T. Isaf; James A. Witherspoon

[57] ABSTRACT

An elongated firing pin is constructed of titanium and defines a plurality of voids therein such that the firing pin is lightweight. The elongated firing pin extends axially and includes a tip at the pin front and a radially extending protrusion at the pin rear. The radially extending protrusion defines a first cavity that is accessible at the pin rear. The firing pin further includes an axially extending external surface and an axially extending internal surface. The internal surface surrounds and defines an elongated, axially extending bore that is accessible at the pin rear. The firing pin further defines a second cavity, and the second cavity is accessible at the external surface proximate to firing pin front. The firing pin additionally defines a third cavity that is also accessible at the exterior surface proximate to the pin front.

21 Claims, 6 Drawing Sheets

LIGHTWEIGHT STRIKER

BACKGROUND OF THE INVENTION

The present invention relates generally to the field of firearms and more particularly to the field of strikers.

Many variables affect the accuracy of a marksman using a firearm. One critical variable that can have a drastic impact upon accuracy is "lock-time". Lock-time is a measure of the delay between the time that the trigger of a firearm is pulled and the corresponding explosion of a cartridge that propels a projectile. It is known that decreases in lock-time result in increases in accuracy. This relationship can be explained, for example, by the fact that a marksman will typically pull the trigger of the firearm at an instant when that firearm is properly aimed at a target. The greater the amount of time between the pulling of the trigger and the explosion of the cartridge, the more likely it is that circumstances will occur that will cause the aim of the firearm to be altered prior to the explosion of the cartridge. One circumstance that obviously affects the aim of a manually held firearm during the lock-time is movement of the firearm, and manually held firearms are, to at least some extent, always moving. Whether the amount of the movement is large or small, it will have some impact upon accuracy. Of course larger movements, such as when a marksman instinctively "flinches" in anticipation of the recoil of the firearm, will have a greater detrimental impact upon accuracy.

The lock-time is, for example, a function of the mass of a striker and the spring constant of a spring that propels the striker in response to the pulling of the trigger. The striker is typically propelled such that it strikes a cartridge in a manner that causes the cartridge to explode, whereby a projectile is propelled from the cartridge and subsequently the firearm. Strikers include, but are not limited to, firing pins and projections on the hammers of hammer-fired firearms. As discussed above, it is movement that occurs during the lock-time that causes decreases in accuracy, and another example of detrimental movements that occur during lock-time are vibrations that occur when the firing pin impacts the cartridge. This vibrating also makes it difficult for a marksman to visually aim the firearm. The vibrating disturbs the marksman's "sight picture" by virtue of the fact that the vibrating causes the firearm to move as the marksman is trying to keep firearm aimed at the target.

Several steps have been taken in the past in an effort to decrease the lock-time and vibrations that disturb the "sight picture". For example, lock-time has been decreased by increasing the spring constant of the striker propelling spring in a rifle. However, such increasing of the spring constant can have the effects of increasing the aforementioned vibrations and increasing the force that is required for pulling the trigger. Additionally, low density materials, such as titanium, have been used in the manufacture of firing pins in an effort to reduce their mass and thereby decrease lock-time. Reductions in mass also reduce the inaccuracy associated with vibrations that disturb the "sight picture", which vibrations are caused when the firing pin impacts against a cartridge. Additionally, material has been removed from the hammers of hammer-fired firearms to decrease lock-time and vibrations.

An exemplary striker, in the form of a prior art firing pin, is disclosed in U.S. Pat. Nos. 4,539,889; 4,825,744; and 4,893,546. The exemplary prior art firing pin is constructed of steel, and is elongated and defines an elongated axis. The exemplary prior art firing pin extends axially and includes an axially extending tip at the firing pin front and a radially extending protrusion at the pin rear. The exemplary prior art firing pin further includes an axially extending external surface, and the firing pin defines a cavity that is accessible at the external surface proximate to pin front. This cavity is defined for the purpose of receiving "safety-related components" of the firearm that the exemplary prior art firing pin is installed in. The "safety-related components" enable and disable a "safety feature" of the firearm. The "safety feature" precludes the firing of the firearm when enabled.

SUMMARY OF THE INVENTION

Briefly described, the present invention provides an improved, lightweight striker. More specifically, provided is an improved, lightweight firing pin. The lightweight firing pin of the preferred embodiments is preferably constructed of a low-density material and preferably defines voids, which low-density material and voids function to decrease the mass of the lightweight firing pin.

The lightweight firing pin of the preferred embodiments is, for example and not limitation, an improvement upon the exemplary prior art firing pin that is discussed above and is partially disclosed in U.S. Pat. Nos. 4,539,889; 4,825,744; and 4,893,546. The lightweight firing pin of the preferred embodiments is preferably constructed from a lightweight material such as, but not limited to, titanium. The lightweight firing pin of the preferred embodiments is initially formed, for example and not limitation, to resemble the prior art firing pin. Then, additional voids are preferably incorporated into the lightweight firing pin of the preferred embodiments to further decrease the mass of the lightweight firing pin. The added voids are strategically sized and oriented such that the structural integrity of the lightweight firing pin of the preferred embodiments is not compromised.

More particularly, the basic configuration of the lightweight firing pin of the preferred embodiments is preferably similar to that of the exemplary firing pin discussed above. However, the lightweight firing pin of the preferred embodiments is improved because, at least: (i) the lightweight firing pin includes an axially extending internal surface which surrounds and defines an elongated, axially extending bore that is accessible at the pin rear; (ii) the lightweight firing pin further defines, in the radially extending protrusion, a second cavity that is accessible at the pin rear; and (iii) the lightweight firing pin additionally defines a third cavity that is accessible at the exterior surface proximate to the pin front, and the third cavity is distant from the first (i.e., prior art) cavity.

It is therefore an object of the present invention to provide an improved striker, or more particularly, an improved firing pin.

Another object of the present invention is to provide a lightweight (i.e., low-mass) firing pin, which lightweight is attributable to strategically placed voids.

Yet another object of the present invention is to provide a lightweight (i.e., low-mass) firing pin by constructing the firing pin of lightweight material.

Still another object of the present invention is to provide a lightweight (i.e., low-mass) firing pin by strategically cutting material away from a prior art firing pin.

Still another object of the present invention is to increase firearm accuracy.

Still another object of the present invention is to decrease lock-time.

Still another object of the present invention is to decrease "sight picture" disturbing vibrations.

Other objects, features and advantages of the present invention will become apparent upon reading and understanding this specification, taken in conjunction with the accompanying drawings.

DETAILED DESCRIPTION OF THE PREFERRED EMBODIMENTS

Figure 1:
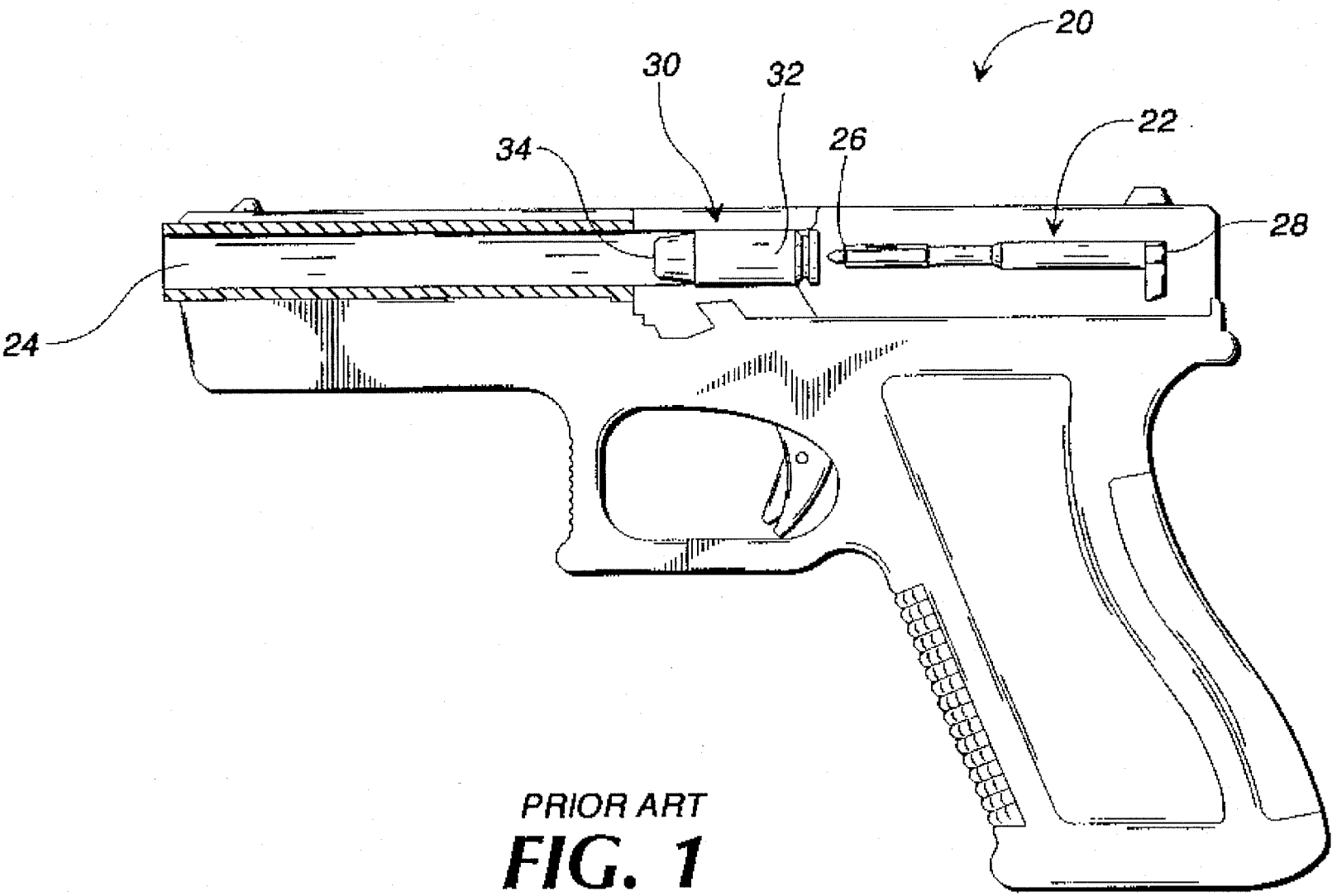
PRIOR ART FIG. 1
FIG. 1 is a partially cut-away, schematic, right side elevational view of a prior art pistol that includes a prior art firing pin.

Referring now in greater detail to the drawings, in which like numerals represent like components throughout the several views, FIG. 1 is a partially cut-away, schematic, right side elevational view of a prior art firearm which is, for example and not limitation, in the form of a prior art pistol 20. The side of the pistol 20 is cut-away to expose a prior art firing pin 22 and barrel 24 of the prior art pistol 20. As discussed in greater detail below, the present invention includes an improved firing pins 84,84' (FIGS. 4–10 and 12). In accordance with the preferred embodiments of the present invention, the firing pin 84 preferably has some similarity to and is preferably used in the place of the prior art firing pin 22 in the prior an pistol 20. The firing pin 22 includes a pin front 26 and a pin rear 28. Portions of the pistol 20 and the barrel 24 are partially cut-away in FIG. 1 to expose a bullet 30. The bullet 30 preferably comprises cartridge 32 having a projectile 34 at one end and a primer (not shown) at the opposite end. In operation, upon the pulling of the trigger of the pistol 20, the firing pin 22 is propelled forward such that the pin front 26 strikes the primer of the cartridge 32 such that the cartridge 32 explodes and forces the projectile 34 through and out of the barrel 24, as should be understood by those reasonably skilled in the art.

For example and not limitation, the prior art pistol 20 is preferably a GLOCK brand automatic pistol, and the prior art firing pin 22 is preferably the firing pin conventionally employed within a GLOCK brand automatic pistol; each of which is at least partially described in U.S. Pat. Nos. 4,539,889; 4,825,744; and 4,893,546; which patents are expressly incorporated, in their entirety, herein by reference. The prior art firing pin 22 is conventionally constructed of steel. For example and not limitation, more specific acceptable examples of the prior art pistol 20 (which includes the prior an firing pin 22) are GLOCK models 17, 19, 20, 21, 22, 23, and 24, which are available from Glock Inc. of Smyrna, Ga.

Figure 2:
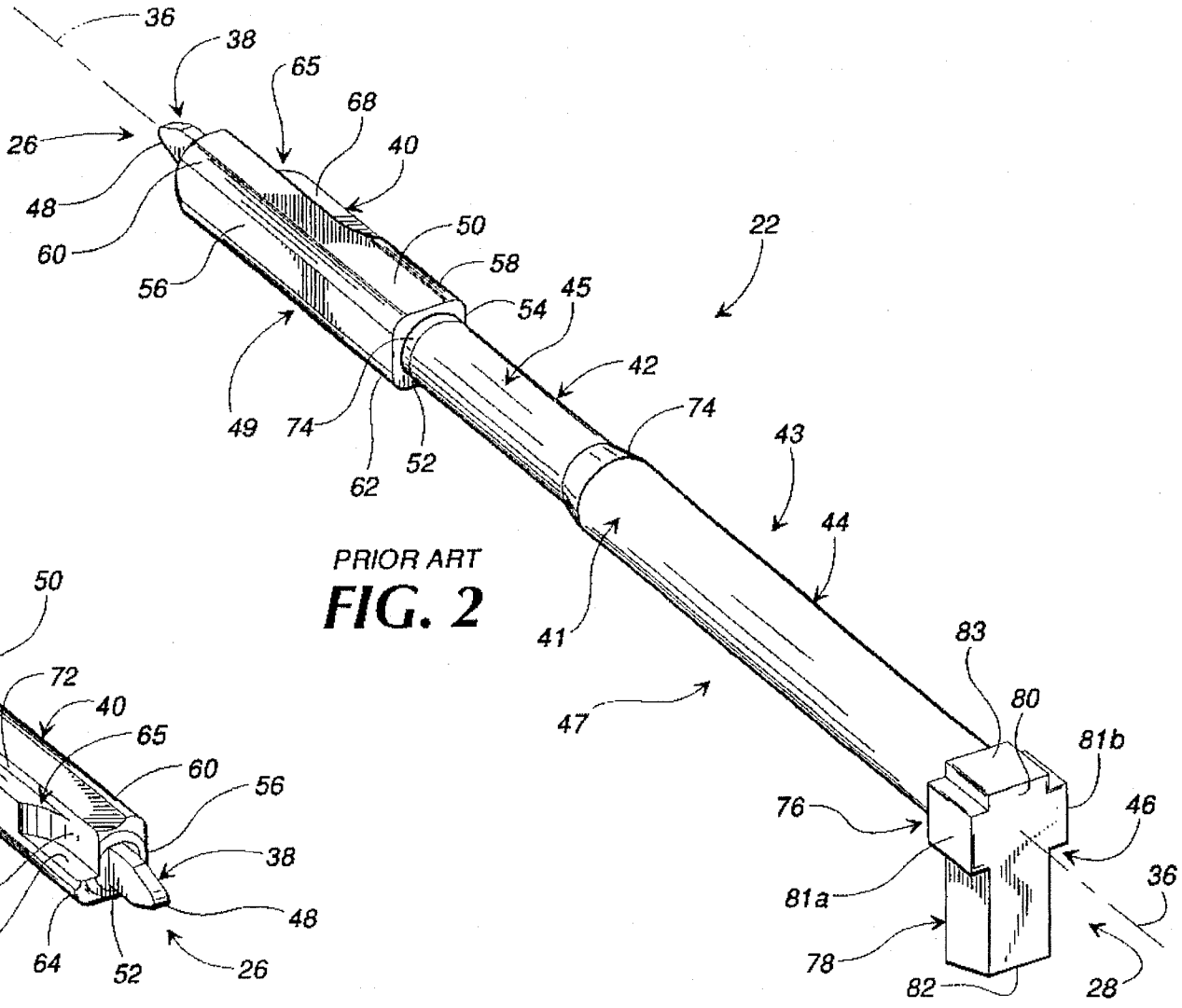
PRIOR ART FIG. 2
FIG. 2 is an isolated, rear, right side, top, perspective view of the prior art firing pin of FIG. 1.

FIG. 2 is an isolated, rear, right side, top, perspective view of the prior art firing pin 22 of FIG. 1. The firing pin 22 includes an elongated pin axis 36 extending between the pin front 26 and the pin rear 28; an axially extending spade section 38 at the pin front 26; an axially extending head section 40 connected to and extending rearward of the spade section 38; an axially extending neck section 42 connected to and extending rearward of the head section 40; an axially extending body section 44 connected to and extending rearward of the neck section 44: and an axially extending foot section 46 connected to and extending rearward of the body section 44. The firing pin 22 further includes a pin right side 41, a pin left side 43, a pin top side 45, and a pin bottom side 47.

Figure 3:
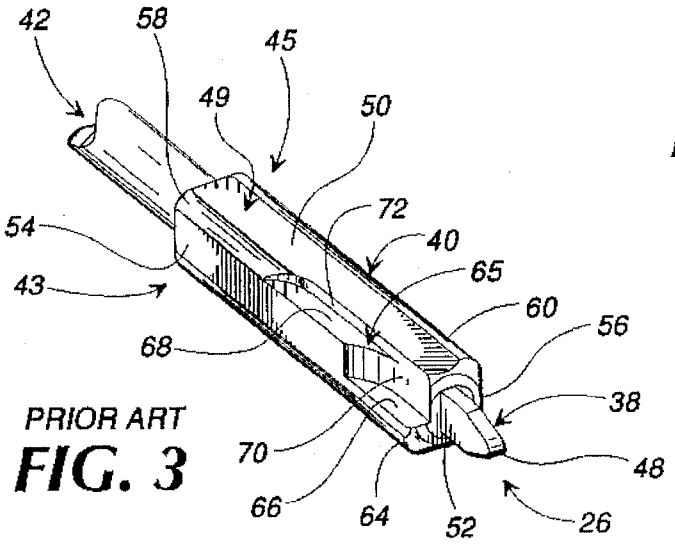
PRIOR ART FIG. 3
FIG. 3 is an isolated, cut-away, front, lea side, top, perspective view of a portion of the prior an firing pin of FIG. 1.

Referring additionally to FIG. 3, which is an isolated, cut-away, front, left side, top, perspective view of a portion of the prior art firing pin 22, the most forward portion of the spade section tapers to form a tip 48. The head section 40 includes a head surface 49 that comprises an upper horizontal head surface 50, a lower horizontal head surface 52, a left vertical head surface 54, and a fight vertical head surface 56, each of which is generally planar and axially extending. The head surface 49 further comprises a plurality of axially extending curved head surfaces 58,60,62 (FIG. 2),64, each of which curves slightly about the pin axis 36, and which span between edges of the head surfaces 50,52,54,56.

The head section 40 defines a head cavity 65 that receives components of the pistol 20 (FIG. 1 ). As eluded to above, the head cavity 65 receives "safety-related components" (not shown) of the pistol 20 that selectively protruded into the head cavity 65 and cooperate with the head section 40. The "safety-related components" enable and disable a "safety feature" of the pistol 20, which "safety feature" precludes the firing of the pistol 20 when enabled, as should be understood by one reasonably skilled in the art upon becoming thoroughly familiar with one of the above-identified examples of an acceptable pistol 20. The head cavity 65 is accessible at the head surface 49, toward the pin front 26, at the pin top side 45, and at the pin left side 43. The head cavity 65 is defined by axially extending horizontal surfaces 66,68 and axially extending vertical surfaces 70,72. The portions of the vertical surfaces 70,72 that are closest to the pin rear 28 (FIG. 2) taper radially away from the pin axis 36 (FIG. 2).

Referring back to FIG. 2 the neck section 42 is cylindrical and defines an annular channel 74 toward the pin front 26. The body section 44 is also cylindrical and defines an annular tapered region 74 toward the pin front 26. The foot section 46 includes a foot base subsection 76 extending axially rearward of the body section 44, a foot extension subsection 78 protruding radially downward from the foot base subsection 76, and a planar, smooth, rear surface 80 spanning both the foot extension subsection 78 and the foot base subsection 76 at the pin rear 28. The foot base subsection 76 includes two diametrically opposed, radially extending protrusions 81*a,b* and a radially extending upper protrusion 83. The foot extension subsection 78 defines somewhat of a rectangular shape having a generally rectangular and smooth bottom surface 82. The bottom surface 82 is slightly curved such that the bottom surface 82 defines a slight radius of curvature with respect to the pin axis 36, as discussed in greater detail below. The body section 44 of the prior art firing pin 22 includes an annular channel 118 (FIGS. 9 and 10) toward the pin rear 28.

Figure 4:
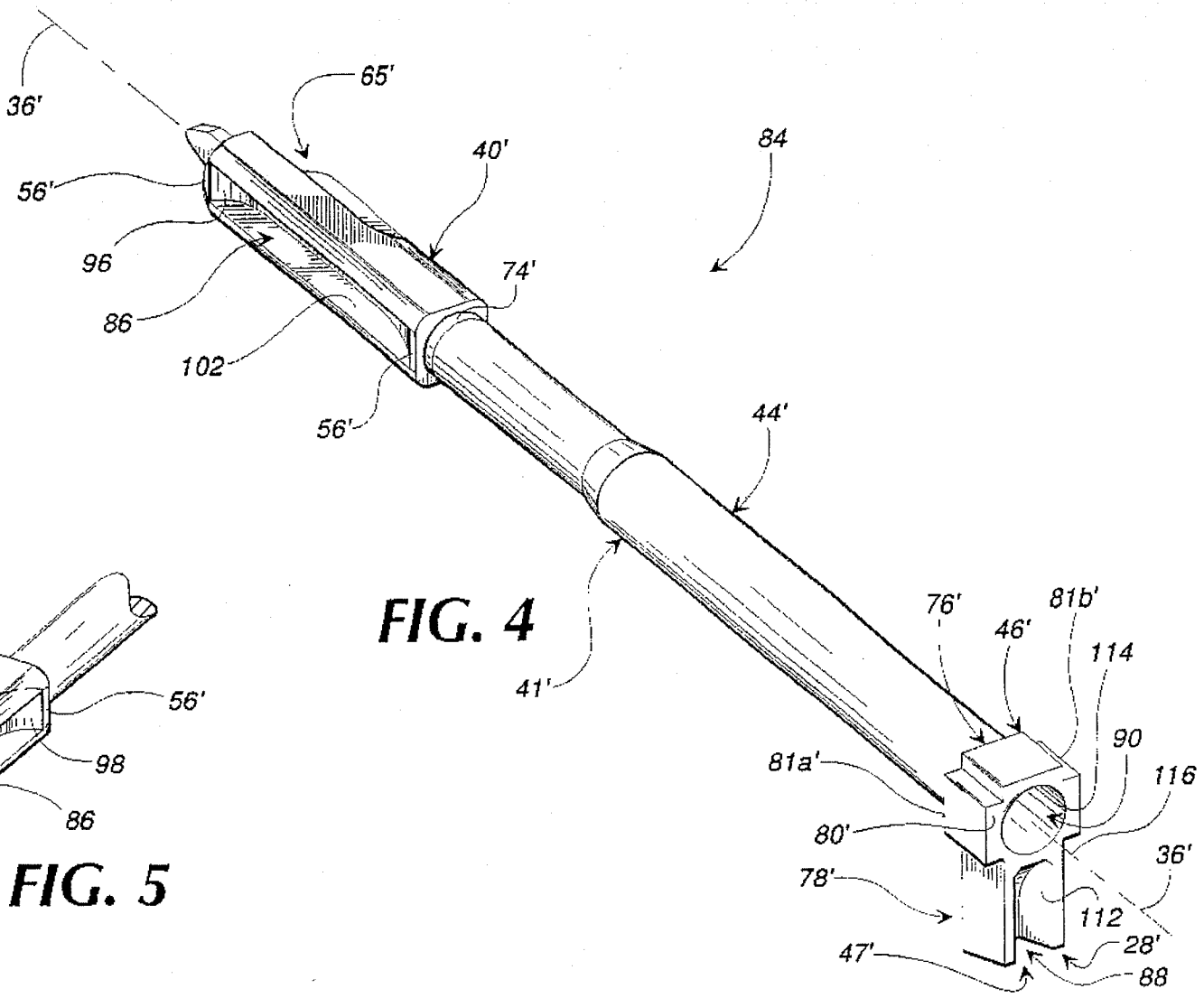
FIG. 4 is an isolated, rear, right side, top, perspective view of a firing pin in accordance with the first preferred embodiment of the present invention.

FIG. 4 is an isolated, rear, right side, top, perspective view of the firing pin 84 in accordance with the first preferred embodiment of the present invention. The firing pin 84 of first preferred embodiment of the present invention is identical to the prior art firing pin 22 (FIGS. 1–3) discussed above, except for the fact that (i) the firing pin 84 is preferably constructed of material lighter than steel such as, but not limited to, titanium, (ii) the firing pin 84 further defines a head cavity 86, (iii) the firing pin 84 further defines a foot cavity 88, and (iv) the firing pin 84 further defines an additional cavity that is preferably in the form of an axially extending cylindrical bore 90.

Figure 5:
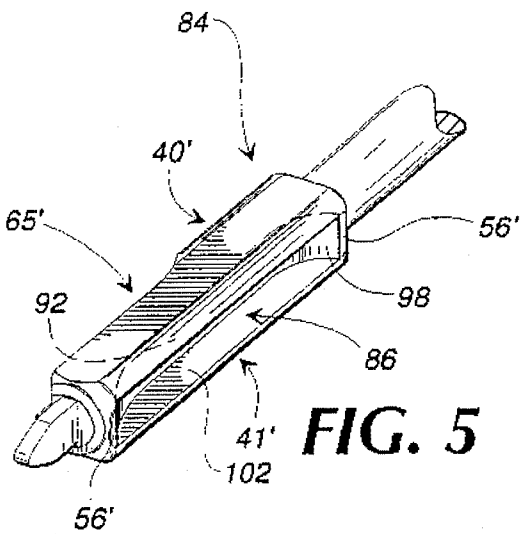
FIG. 5 is an isolated, cut-away, front, right side, top, perspective view of a portion of the firing pin of FIG. 4.
Figure 6:
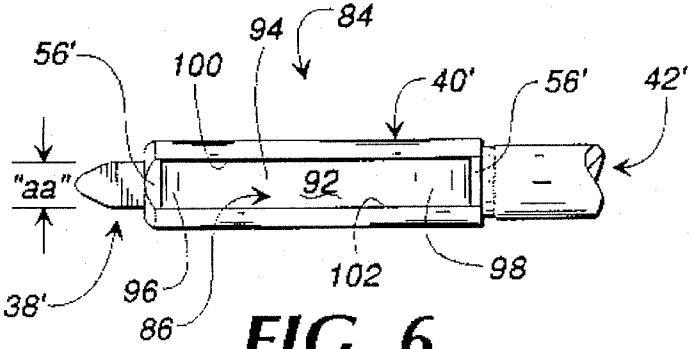
FIG. 6 is an isolated, cut-away, right side, elevational, isometric view of the firing pin of FIG. 4.

FIG. 5 is an isolated, cut-away, front, right side, top, perspective view of the firing pin 84, and FIG. 6 is an isolated, cut-away, fight side, elevational, isometric view of the firing pin 84, in accordance with the first preferred embodiment of the present invention. Referring to FIGS. 4–6, the head cavity 86 is accessible at the pin right side 41' (FIGS. 4 and 5). The head cavity 86 is preferably formed by cutting through the right vertical head surface 65' and into the internal portion of the head section 40', which cutting is acceptably accomplished with a tool such as, but not limited to, a key seat cutter having a diameter of approximately 0.375 inches and a width of approximately 0.09375 inches. Portions of the right vertical head surface 56' remain toward opposite ends of the head cavity 86. Referring in particular to FIG. 6, the head cavity 86 is defined by a vertical surface 92 which includes a planar and axially extending surface midsection 94 and opposite surface ends 96,98 which extend from opposite ends of the midsection 94 and curve radially away from the pin axis 36'. The head cavity 86 is further defined by planar, horizontal surfaces 100,102 which extend outward from the upper and lower edges, respectively of the vertical surface 92. Referring back to FIG. 5, the lower edge of the vertical surface 92 is seen, and the upper edge of the vertical surface 92 is depicted by a broken line.

Figure 8:
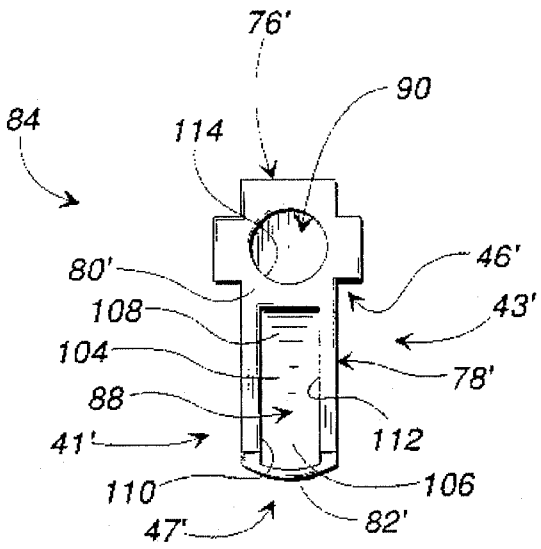
FIG. 8 is an isolated, rear elevational, isometric view of the firing pin of FIG.
Figure 7:
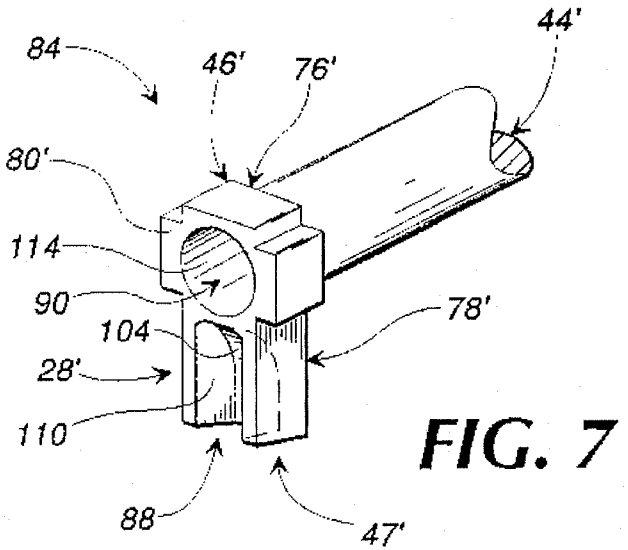
FIG. 7 is an isolated, cut-away, rear, left side, perspective view of the firing pin of FIG. 4.

FIG. 7 is an isolated cut-away, rear, left side, perspective view and FIG. 8 is a rear, elevational, isometric view of the firing pin 84, in accordance with the first preferred embodiment of the present invention. Referring to FIGS. 4, 7, and 8, the foot cavity 88 is accessible at the pin rear 28' (FIGS. 4 and 7) and the pin bottom side 47'. Referring in particular to FIG. 8, the foot cavity 88 is preferably formed by cutting through the rear surface 80' and the bottom surface 82', and into the internal portion of the foot extension subsection 78'; which cutting is acceptably accomplished with a tool such as, but not limited to, a key seat cutter having a diameter of approximately 0.375 inches and a width of approximately 0.09375 inches. The foot cavity 88 is defined by a radially extending surface 104 which includes a vertical planar portion 106 and a curved portion 108 that extends from the upper edge of the planar portion 106 and curves toward the axial direction at the pin rear 28' (FIGS. 4 and 7). The foot cavity 88 is further defined by planar vertical surfaces 110, 112 which extend outward from the right and left side edges, respectively of the radially extending surface 104. Referring back to FIG. 7, the right side edge of the radially extending surface 104 is seen, and the left side edge of the radially extending surface 104 is depicted by a broken line.

Referring to FIGS. 4, 7, and 8, the bore 90 is accessible at the pin rear 28' (FIGS. 4 and 7) and is preferably formed by boring through the rear surface 80'. The bore 90 extends through the foot base subsection 76' and into the body section 44' (FIGS. 4 and 7). The bore 90 is defined by an axially extending internal surface 114. The internal surface defines a bore axis 116 (FIG. 4) that is preferably collinear with the pin axis 36'.

Figure 9:
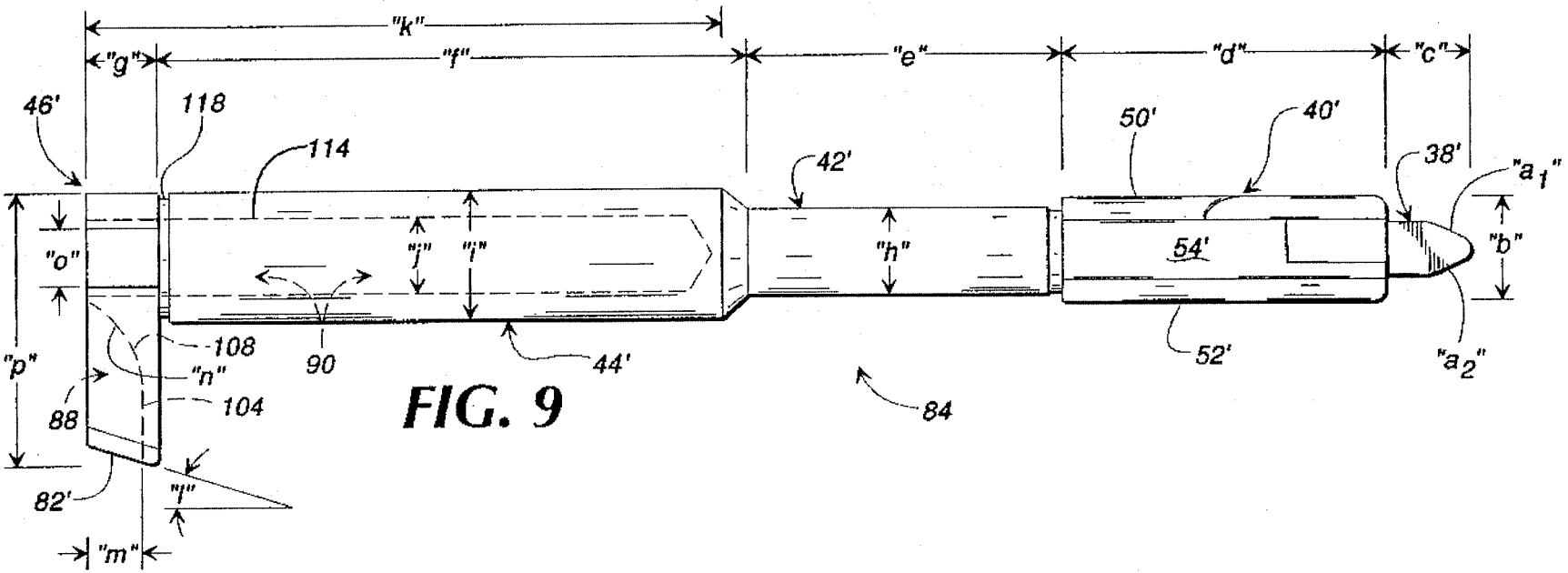
FIG. 9 is an isolated, left side elevational view of the firing pin of FIG. 4.

FIG. 9 is an isolated, left side elevational view of the pin 84, in accordance with the first preferred embodiment of the present invention. Upper and lower edges of the spade section 38' define arcs "a1" and "a2", each of which preferably defines a radius of curvature of approximately 0.048 inches. A dimension "b" represents the distance between the upper horizontal head surface 50' and the lower horizontal head surface 52'. The dimension "b" is also representative of the distance between the left vertical head surface 54' and the right vertical head surface 56' (FIG. 4). Dimension "b" is preferably approximately 0.171 inches. The dimension "c" represents the axial length of the spade section 38', and the dimension "c" is preferably approximately 0.115 inches. The dimension "d" represents the axial length of the head section 40'. In accordance with the first preferred embodiment of the present invention, the dimension "d" is preferably approximately 0.596 inches. The dimension "e" represents the axial length of the neck section 42', and the dimension "e" is preferably approximately 0.464 inches. The dimension "f" represents the axial length of the body section 44', and the dimension "f" is preferably approximately 1.051 inches. The dimension "g" represents the axial length of the foot section 46', and the dimension "g" is preferably approximately 0.121 inches. The dimension "h" represents the outer diameter of the neck section 42', and the dimension "h" is preferably approximately 0.153 inches. The dimension "i" represents the outer diameter of the body section 44', and the dimension "i" is preferably approximately 0.189 inches. The dimension "j" represents the diameter of the bore 90, and the dimension "j" is preferably approximately 0.125 inches. The dimension "k" represents the axial length of the bore 90, and the dimension "k" is preferably approximately 1.100 inches. The bottom surface 82' of the foot section 46' defines an angle "i" with respect to the horizon, and the angle "T" is preferably 15 degrees. The dimension "m" represents the maximum axial depth of the foot cavity 88, and the dimension "m" is preferably approximately 0.100 inches. The curved portion 108 of the radially extending surface 104 of the foot section 46' defines an arc "n", and the arc "n" preferably defines a radius of curvature of approximately 0.1875 inches. The dimension "o" represents the height of each of the two diametrically opposed protrusions 81*a',b'* (FIG. 4) of the foot section 46' , and the dimension "o" is preferably approximately 0.115 inches. The dimension "p" represents the height of the foot section 46', and the dimension "p" is preferably approximately 0.440 inches. The annular channel 74' of the body section 44' preferably defines an outer diameter of approximately 0.180 inches.

Figure 10:
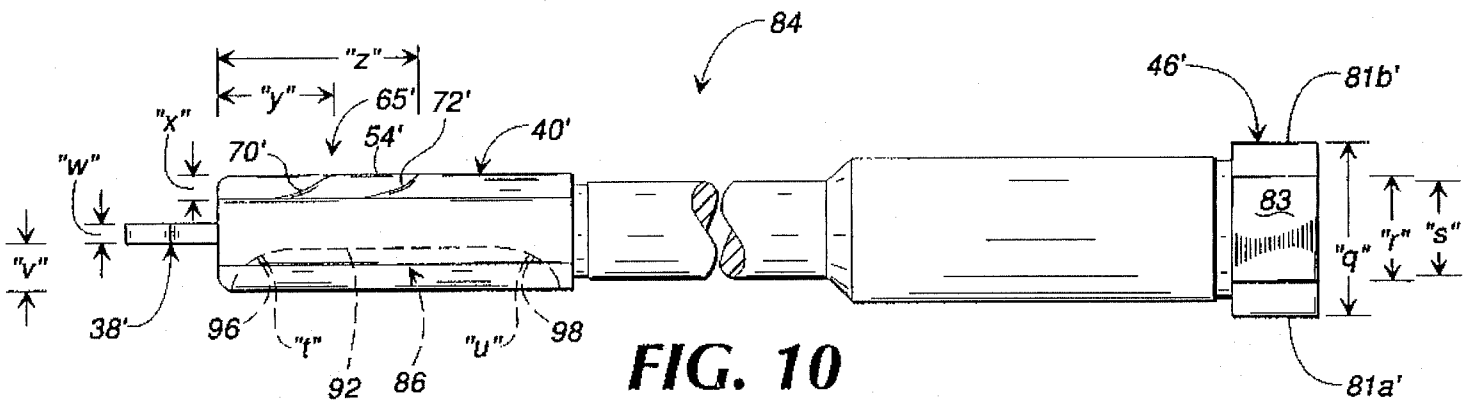
FIG. 10 is an isolated, partially cut-away, top plan view of the firing pin of FIG. 4.

FIG. 10 is an isolated, partially cut-away, top plan view of the firing pin 84, in accordance with the first preferred embodiment of the present invention. The dimension "q" represents the distance between the distant sides of the two diametrically opposed protrusions 81*a',b'* of the foot section 46', and the dimension "q" is preferably approximately 0.233 inches. The dimension "r" represents the width of the upper protrusion 83 of the foot section 46'and the width of the foot extension subsection 78' (FIGS. 4, 7, and 8) of the foot section 46', and the dimension "r" is preferably approximately 0.151 inches. The dimension "s" represents the distance between the vertical surfaces 110,112 (FIG. 8) and therefore the width of the foot cavity 88 (FIGS. 4, 7, and 8), and the dimension "s" is preferably approximately 0.09375 inches. The opposite surface ends 96,98 of the vertical surface 92 define arcs "t" and "u" respectively, and the arcs "t" and "u" preferably each define a radius of curvature of approximately 0.1875 inches. The dimension "v" represents the maximum radial depth of the head cavity 86 with respect to the right vertical head surfaces 56' (FIGS. 5 and 6), and the dimension "v" is preferably approximately 0.100 inches. The dimension "w" represents the thickness of the spade 38', and the dimension "w" is preferably approximately 0.034 inches. The dimension "x" represents the radial depth of the head cavity 65' with respect to the left vertical head surface 54', and the dimension "x" is preferably approximately 0.045 inches. The dimension "y" represents the axial length of the vertical surface 70', and the dimension "y" is preferably approximately 0.180 inches. the dimension "z" represents the axial length of the vertical surface 72', and the dimension "z" is preferably approximately 0.360 inches. Referring back to FIG. 6, the dimension "aa" represents the distance between the horizontal surfaces 100, 102, and thereby the height of the head cavity 86, and the dimension "aa" is preferably approximately 0.09375 inches.

Figure 11:
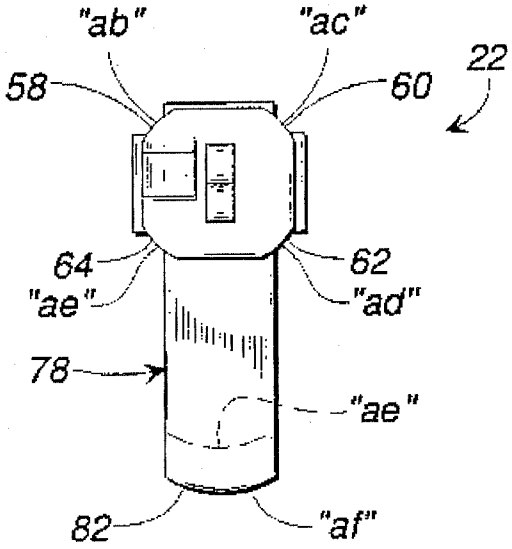
PRIOR ART FIG. 11
FIG. 11 is an isolated, front elevational view of the prior art firing pin of FIG. 1.

FIG. 11 is an isolated, front elevational view of the prior art firing pin 22 which discloses features of the firing pin 22 that, in accordance with the first preferred embodiment of the present invention, preferably generally correspond to the firing pins 84,84' (FIGS. 4–10 and 12). The axially extending curved head surfaces 58,60,62,64 (FIGS. 2 and 3) define arcs "ab","ac","ad","ae", and each of the arcs "ab","ac", "ad","ae" preferably defines a radius of curvature, with respect to the pin axis 36 (FIG. 1), of approximately 0.0975 inches. The rearward most edge of the bottom surface 82 of the foot extension subsection 78 defines an arc "ae", and the arc "ae" preferably defines a radius of curvature of approximately 0.315 inches with respect to the pin axis 36 (FIG. 1). The forward most edge of the bottom surface 82 of the foot extension subsection 78 defines an arc "af", and the arc "af" preferably defines a radius of curvature of approximately 0.344 inches with respect to the pin axis 36 (FIG. 1).

Figure 12:
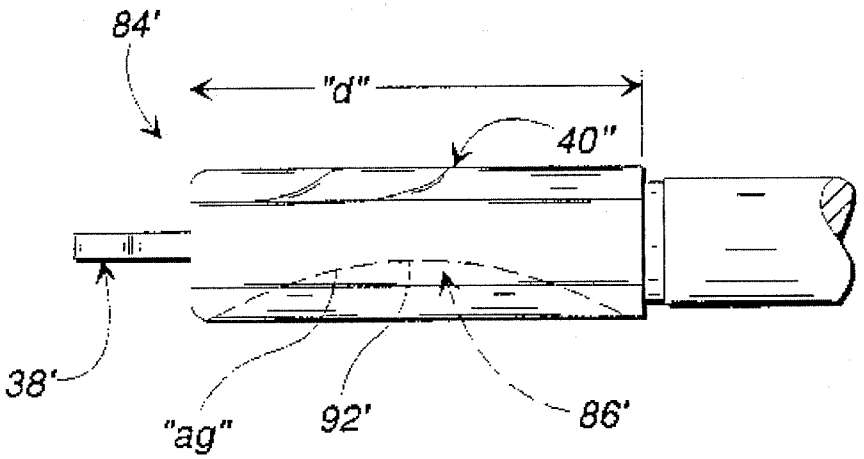
FIG. 12 is an isolated, partially cut-away, top plan view of a segment of a firing pin in accordance with a second preferred embodiment of the present invention.

FIG. 12 is an isolated, partially cut-away, top plan view of a segment of the firing pin 84 ', in accordance with a second preferred embodiment of the present invention. Except for the specific differences discussed below, the firing pin 84' of the second preferred embodiment is identical to the firing pin 84 (FIGS. 4–10) of the first preferred embodiment. In accordance with the second preferred embodiment of the present invention, the dimension "d'" represents the axial length of the head section 40", and the dimension "d'" is preferably approximately 0.435 inches. In accordance with the second preferred embodiment, the vertical surface 92' is in the form of a continuous arc "ag" that extends from proximate to the forward most portion of the head section 40" to proximate to the rearward most portion of the head section 40". The arc "ag" preferably defines a radius of curvature equal to approximately 0.1875 inches.

While the embodiments of the present invention which have been disclosed herein are the preferred forms, other embodiments of the method and apparatus of the present invention will suggest themselves to persons skilled in the art in view of this disclosure. Therefore, it will be understood that variations and modifications can be effected within the spirit and scope of the invention and that the scope of the present invention should only be limited by the claims below. It is also understood that any relative dimensions and relationships shown on the drawings are given as the preferred relative dimensions and relationships, but the scope of the invention is not to be limited thereby.

We claim:

1. An elongated firing pin comprising:

a pin front;

a pin rear, wherein the elongated axis of the firing pin extends between said pin front and said pin rear;

an axially extending spade section at said pin front;

an axially extending head section connected to and extending rearward of said spade section, wherein said head section includes an axially extending head surface at least partially surrounding said pin axis, wherein said head section defines a first cavity that is open at said head surface, and wherein said head section includes an axially extending curved surface that at least partially defines a second cavity, wherein said axially extending curved surface includes opposite ends that extend, at least partially, in the radial direction, and wherein said second cavity is axially extending and is open at said head surface at a position that is distant from said first cavity;

an axially extending body section extending rearward of said head section, wherein said body section includes an axially extending and generally cylindrical internal wall that at least partially encircles and defines an axially extending bore; and a foot section at said pin rear, said foot section including an axially extending foot base connected to and extending rearward of said body section, wherein said foot base includes an internal wall that at least partially encircles and defines said bore, and a foot extension extending radially from said foot base, wherein said foot extension includes a radially extending curved surface that at least partially defines a third cavity, said radially extending curved surface including an end that extends, at least partially, in the axial direction.

2. In an elongated firing pin including a pin-front; a pin rear; an elongated pin axis extending between the pin front and the pin rear; an axially extending spade section at the pin front; an axially extending head section extending rearward of the spade section, the head section including an axially extending head surface at least partially surrounding the pin axis, and the head section defining a first cavity that is open at the head surface; an axially extending neck section extending rearward of the head section; an axially extending body section extending rearward of the neck section; and a foot section at the pin rear, the foot section including an axially extending foot base extending rearward of the body section and a foot extension extending radially from the foot base; an improvement thereto comprising:

said body section including a cylindrical internal wall that at least partially encircles and defines a second cavity.

3. The firing pin of claim 2, wherein said cylindrical internal wall and said second cavity extend axially within said body section.

4. The firing pin of claim 3, wherein said foot extension defines a third cavity, and wherein said head section defines a fourth cavity, wherein said fourth cavity is open at said head surface at a position distant from said first cavity.

5. The firing pin of claim 4, wherein said foot section at least partially defines a fifth cavity, wherein said foot extension includes a radially extending curved surface that at least partially defines said fifth cavity, said radially extending curved surface including an end that extends, at least partially, in the axial direction.

6. The firing pin of claim 3, wherein said second cavity is an axially extending bore, wherein said head section at least partially defines a third cavity, wherein said third cavity is open at said head surface at a position distant from said first cavity, wherein said head section includes an axially extending curved surface that at least partially defines said third cavity, wherein said axially extending curved surface includes opposite ends, and wherein said opposite ends extend, at least partially, in the radial direction, and wherein said foot extension defines a fourth cavity.

7. A firing pin comprising:

an elongated member section, said member section including a member front, a member rear, wherein the elongated axis of said member section extends between said member front and said member rear, and an axially extending member surface at least partially surrounding the elongated axis, said member section defining a first cavity that is open at said member surface, said member section further defining a second cavity that is open at said member surface at a position distant from said first cavity, and said member section further including a generally cylindrical internal wall that least partially encircles and defines a third cavity; and a protrusion section connected to and extending radially from said member section proximate to said member rear, wherein said protrusion section includes a radially extending curved surface that at least partially defines a fourth cavity, and wherein said radially extending curved surface includes an end that extends, at least partially, in the axial direction.

8. In an elongated firing pin including a pin front; a pin rear; an elongated pin axis extending between the pin front and the pin rear; an axially extending spade section at the pin front; an axially extending head section extending rearward of the spade section, the head section including an axially extending head surface at least partially surrounding the pin axis, and the head section defining a first cavity that is open at the head surface; an axially extending neck section extending rearward of the head section; an axially extending body section extending rearward of the neck section; and a foot section at the pin rear, the foot section including an axially extending foot base extending rearward of the body section and a foot extension extending radially from the foot base; an improvement thereto comprising:

said foot base includes an axially extending and generally cylindrical internal wall that at least partially encircles and defines a second cavity.

9. In an elongated firing pin including a pin front; a pin rear; an elongated pin axis extending between the pin front and the pin rear; an axially extending spade section at the pin front; an axially extending head section extending rearward of the spade section, the forward portion of the head section extending generally radially, generally annularly, and generally perpendicularly away from the rear portion of the spade section, the head section including an axially extending and generally rectangularly shaped head surface that at least partially surrounds the pin axis, and the head section defining a first cavity and a second cavity that are contiguous and open at the head surface; an axially extending and generally cylindrical neck section extending rearward of the head section, the rear portion of the head section extending generally radially, generally annularly, and generally perpendicularly away from the forward portion of the neck section, and the forward portion of the neck section defining a generally annular channel that at least partially bounds the pin axis; a generally cylindrical and axially extending body section extending rearward of the neck section and defining a greater radius than the neck section, the rear portion of the body section defining a generally annular channel that at least partially bounds the pin axis; and a foot section at the pin rear, the foot section extending generally radially, generally annularly, and generally perpendicularly away from the rear portion of the body section, the foot section including an axially extending foot base extending rearward of the body section, and a plurality of foot protrusions extending radially from the foot base, wherein the plurality of foot protrusions are angularly displaced about the pin axis and cooperate to defined four notches, wherein each notch of the four notches is defined between a pair of the foot protrusions of the plurality of foot protrusions; an improvement thereto comprising:

said firing pin further defining a third cavity, wherein said third cavity is defined, at least partially, by a section of said firing pin selected from said head section, said body section, and said foot section.

10. The firing pin of claim 9, wherein said firing pin further defines a fourth cavity, wherein said fourth cavity is defined, at least partially, by a section of said firing pin selected from said head section, said body section, and said foot section.

11. The firing pin of claim 10, wherein said firing pin further defines a fifth cavity, wherein said fifth cavity is defined, at least partially, by a section of said firing pin selected from said head section, said body section, and said foot section.

12. The firing pin of claim 9, wherein said third cavity is defined, at least partially, by said head section, and wherein said head section includes an axially extending curved surface that at least partially defines said third cavity, and wherein said axially extending curved surface includes opposite ends that extend, at least partially, in the radial direction.

13. The firing pin of claim 12, wherein said third cavity is axially extending and is open at said head surface at a position that is diametrically opposed from said first cavity and said second cavity.

14. The firing pin of claim 13, wherein said firing pin further defines a fourth cavity, wherein said fourth cavity is defined, at least partially, by a section of said firing pin selected from said body section, and said foot section.

15. The firing pin of claim 9, wherein said body section includes a cylindrical wall that at least partially encircles and defines said third cavity.

16. The firing pin of claim 15, wherein said cylindrical wall is axially extending and said third cavity is in the form of an axially extending bore.

17. The firing pin of claim 16, wherein said foot base includes an internal wall that at least partially encircles and further defines said axially extending bore.

18. The firing pin of claim 17, wherein said firing pin further defines a fourth cavity, wherein said fourth cavity is defined, at least partially, by a section of said firing pin selected from said head section and said foot section.

19. The firing pin of claim 9, wherein said foot section includes a cylindrical internal wall that at least partially encircles and defines said third cavity, and wherein said cylindrical internal wall is axially extending and said third cavity is in the form of an axially extending bore.

20. The firing pin of claim 19, wherein said firing pin further defines a fourth cavity, wherein said fourth cavity is defined, at least partially, by a section of said firing pin selected from said head section and said body section.

21. The firing pin of claim 9, wherein a foot protrusion of said plurality of foot protrusions includes a radially extending curved surface that at least partially defines said third cavity, said radially extending curved surface including an end that extends, at least partially, in the axial direction, and wherein said firing pin further defines a fourth cavity, wherein said fourth cavity is defined, at least partially, by a section of said firing pin selected from said head section and said body section.

* * * * *